US006302369B1

(12) United States Patent
Liebers et al.

(10) Patent No.: US 6,302,369 B1
(45) Date of Patent: Oct. 16, 2001

(54) EYEGLASS DISPLAY RACK AND TRAY THEREFOR

(75) Inventors: Steven B. Liebers, Norristown, PA (US); Boris B. Liebers, Alfe Menashe (IL)

(73) Assignee: Diversified Products, Inc., Norristown, PA (US)

( * ) Notice: Subject to any disclaimer, the term of this patent is extended or adjusted under 35 U.S.C. 154(b) by 0 days.

(21) Appl. No.: 09/492,972

(22) Filed: Jan. 27, 2000

(51) Int. Cl.[7] ..... A47F 7/02

(52) U.S. Cl. ..... 248/902; 248/205.3; 248/309.1

(58) Field of Search ..... 248/902, 205.3, 248/309.1

(56) References Cited

U.S. PATENT DOCUMENTS

| | | | | |
|---|---|---|---|---|
| D. 185,746 | | 7/1959 | Glover | D80/9 |
| D. 223,784 | | 6/1972 | Rios | D80/9 |
| D. 251,596 | | 4/1979 | Priestley, Jr. | D16/82 |
| D. 298,436 | | 11/1988 | Pralutsky | D16/129 |
| D. 314,114 | | 1/1991 | Steinman | D6/512 |
| D. 321,444 | | 11/1991 | Khantzis | D6/468 |
| D. 374,786 | | 10/1996 | Liebers | D6/468 |
| D. 391,759 | | 3/1998 | Zudall | D3/219 |
| D. 393,557 | | 4/1998 | Guccione | D6/55 |
| D. 429,417 | * | 8/2000 | Liebers et al. | D3/266 |
| 993,404 | * | 5/1911 | Price . | |
| 2,623,722 | * | 12/1952 | Glunt et al. | 248/300 |
| 2,808,941 | * | 10/1957 | Foster | 211/13 |
| 3,195,731 | | 7/1965 | Bomar, Jr. | 211/13 |
| 4,204,602 | | 5/1980 | Dunchock | 211/13 |
| 4,211,331 | * | 7/1980 | Salmon et al. | 211/13 |
| 4,976,532 | | 12/1990 | Nyman | 351/158 |
| 5,056,668 | | 10/1991 | Berger | 211/13 |
| 5,069,416 | | 12/1991 | Ennis | 248/902 |
| 5,100,006 | | 3/1992 | Forrester | 211/13 |
| 5,101,986 | * | 4/1992 | Holztrager | 211/13 |
| 5,316,252 | | 5/1994 | Charnow et al. | 248/223.4 |
| 5,340,074 | * | 8/1994 | Porcaro et al. | 248/309.1 |
| 5,861,941 | | 1/1999 | Liebers | 351/245 |

* cited by examiner

*Primary Examiner*—Leslie A. Braun
*Assistant Examiner*—Steve M Marsh
(74) *Attorney, Agent, or Firm*—Caesar, Rivise, Bernstein, Cohen & Pokotilow, Ltd.

(57) ABSTRACT

A tray adapted to support eyeglasses comprising a flat base, a lip projecting upwardly at the front of the base and a flange projecting upwardly at the rear of the base. The lip and flange are angled outwardly from the base. A vertically-extending bar is positioned in the middle of the base and extends from the rear flange to the front lip. The bottom of the bar is horizontal and is secured to the base. The ends of the bar project at the same angles as the lip and flange. A plurality of spaced trays can be secured to a rack, for holding eyeglasses for display and vending. The base of the tray projects at an acute angle relative to the wall of the rack on which it is mounted. Eyeglasses placed on the tray will automatically slide to the rear of the tray, under the force of gravity caused by the angle of inclination of the tray.

21 Claims, 4 Drawing Sheets

FIG.4
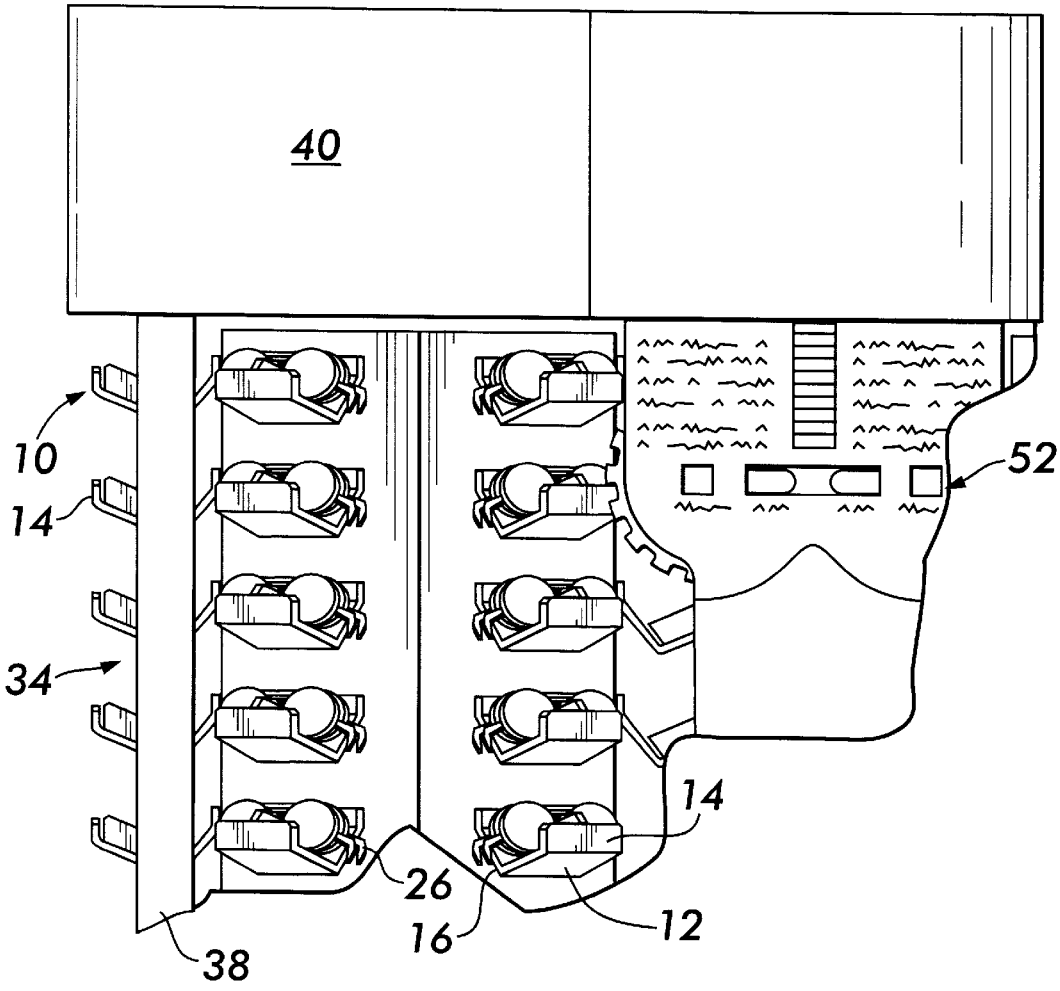
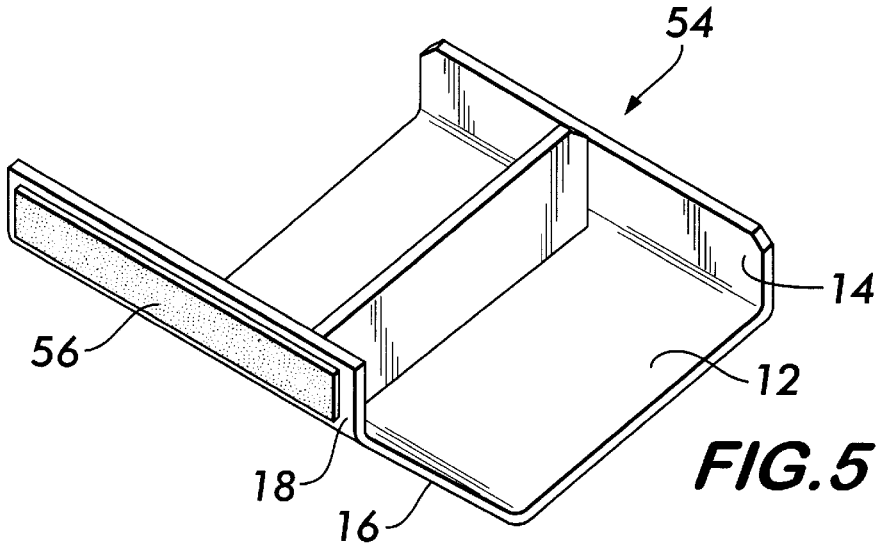
FIG.5

EYEGLASS DISPLAY RACK AND TRAY THEREFOR

BACKGROUND OF THE INVENTION

This invention relates to product displays, in general, and, more particularly, to an eyeglass display rack and to trays used for displaying and vending eyeglasses.

It is now a common practice to sell non-prescription reading glasses directly to the consumer at pharmacies and other retail outlets. The non-prescription reading glasses are displayed in a retail establishment on free-standing displays.

Typically, a consumer selects a pair of non-prescription reading glasses from the display by trying on a number of pairs until he locates a pair that is suitable, from the standpoint of comfort, magnifying ability and appearance. In order to determine the appropriate magnifying ability for the reading glasses, charts are placed on the displays for the reading glasses. The charts have increasing sizes of print, and the purchaser of the reading glasses is instructed to stand approximately 14 inches (35.6 cm.) from the chart. When viewing the chart, the consumer will look at each line of print, and note the first line of print that appears to be out of focus. By reading across the chart the consumer can then determine the amount of magnification needed for the reading glasses. The amount is expressed in diopters, an optical unit of measurement.

Once the consumer determines the appropriate amount of magnification needed, the consumer will then view all of the glasses on the display rack that have lenses at the appropriate diopter rating. The consumer can then select a pair of reading glasses which the consumer finds to be attractive and comfortable.

An improvement over the use of the chart for determining the proper amount of magnification needed is disclosed in our U.S. Pat. No. 5,861,941, which issued on Jan. 19, 1999. That patent discloses a vision tester that is incorporated into a display rack, which vision tester accurately determines the appropriate magnification needed for the non-prescription reading glasses contained on the display rack. The display rack includes a number of vertically and horizontally spaced supports for the non-prescription reading glasses, which supports are shown in greater detail in U.S. Pat. No. Des. 374,786, which issued on Oct. 22, 1996.

The eyeglass support of U.S. Design Pat. No. 374,786, which design was invented by one of the inventors herein, has been found to be aesthetically pleasing and functional, in that it effectively supports non-prescription reading glasses that are to be displayed and vended from the display. However, it has been found in practice that placing the eyeglasses on the support is not always precisely done when a consumer tries on a pair of eyeglasses and has to put them back on the support. The support requires that the temples be received in slots, but the consumer does not always place the temples in the slots, thereby having the eyeglasses placed in an imprecise manner on the support.

Prior to the invention of the support shown in U.S. Design Pat. No. 374,786, various other supports were developed for vending eyeglasses. These supports are shown in U.S. Pat. Nos. 4,976,532, 5,056,668 and 5,100,006. Although the supports shown in these patents appear to be effective for holding and displaying eyeglasses, they all require that precision be shown in placing the eyeglasses on the support.

The eyeglass display rack incorporating the novel display tray of this invention presents an attractive display for the eyeglasses. The eyeglasses can be placed on the tray with a minimum of care, yet they will always be precisely in place and present an attractive appearance.

SUMMARY OF THE INVENTION

A tray adapted to support eyeglasses comprising a flat base, a lip projecting upwardly at the front of the base and a flange projecting upwardly at the rear of the base. The lip and flange are angled outwardly from the base. A vertically-extending bar is positioned in the middle of the base, and extends from the rear flange to the front lip. The bottom of the bar is horizontal, and is secured to the base. The ends of the bar project at the same angles as the lip and flange. A plurality of spaced trays can be secured to a rack, for holding eyeglasses for display and vending.

DESCRIPTION OF THE DRAWINGS

Objects and many of the attendant advantages of this invention will become readily appreciated as the same becomes better understood by reference to the following detailed description, when considered in connection with the accompanying drawing, wherein:

FIG. 4 is an enlarged front elevational view showing a segment of the display rack of FIG. 2; and, FIG. 5 is a perspective view of a modified embodiment of the tray of this invention.

DETAILED DESCRIPTION OF THE PREFERRED EMBODIMENT

Figure 1:
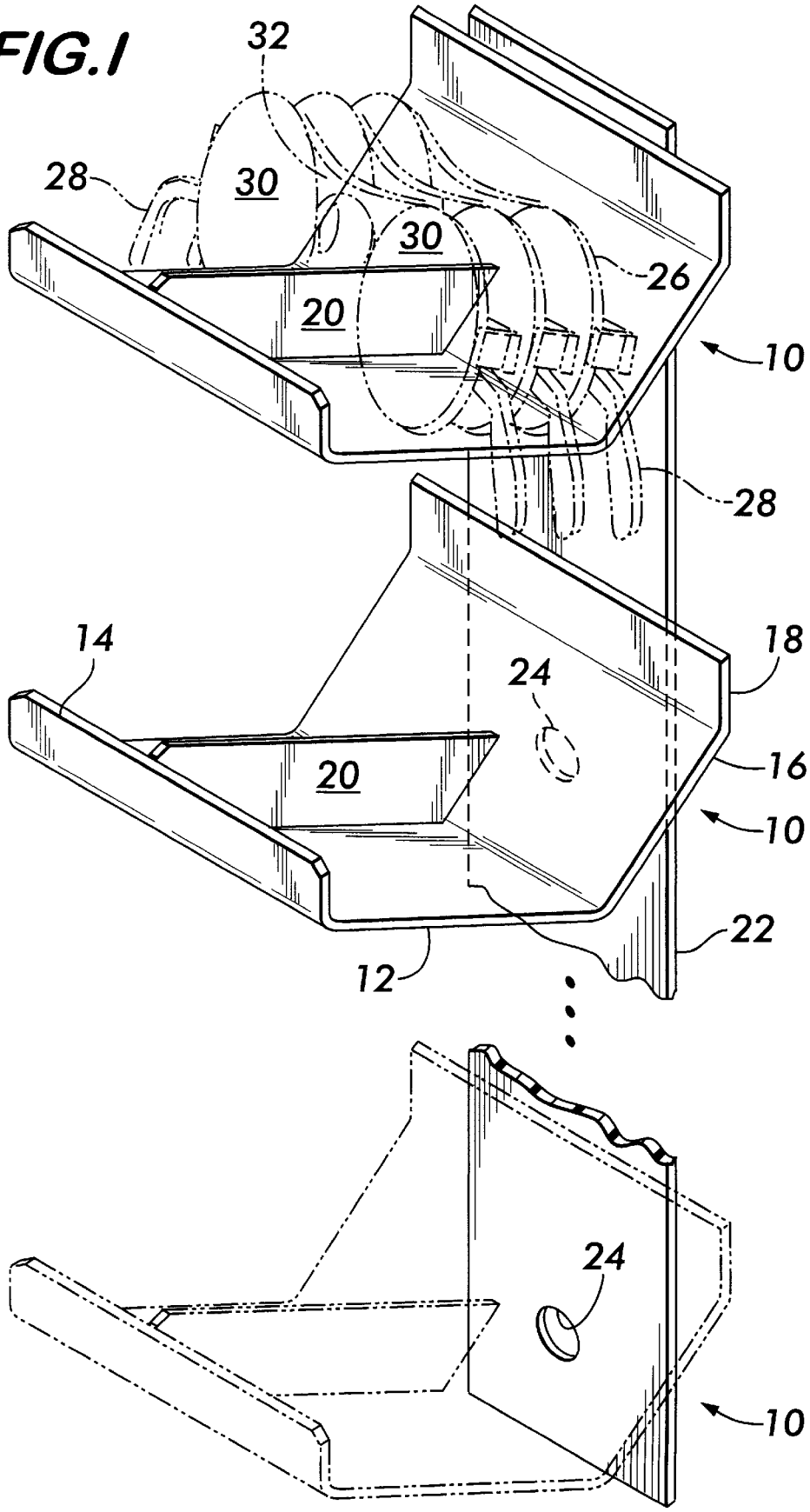
FIG. 1 is a perspective view, partially broken away, showing a plurality of the eyeglass support trays posed on a mounting bar.

Referring now in greater detail to the various figures of the drawing, wherein like reference characters refer to like parts, an eyeglass support tray embodying the present invention is generally shown at 10 in FIG. 1. The tray comprises a flat base 12, a forward lip 14 projecting upwardly from the front of the base and a flange 16 projecting upwardly at the rear of the base. As seen in FIGS. 1 and 4, the lip and flange project at an obtuse angle relative to the base.

Flange 16 includes an upwardly-projecting lip 18. Lip 18 projects from the flange 16 at an obtuse angle. The base 12, lip 14, flange 16 and lip 18 are unitary, and are formed from a single sheet of transparent plastic, such as polystyrene. Other rigid plastics known to the art can be used, and translucent or opaque plastics can be used instead of the transparent plastic.

A bar 20 is positioned in the center of base 12 and extends from lip 14 to flange 18. The bar is made from the same plastic as the base and its associated flange and lips, and accordingly can be polystyrene. The bar is flat and is secured to the base, by heat welding or any suitable adhesive that will adhere the two pieces of plastic from which the bar and base are made.

A plurality of trays 10 are supported in vertically-spaced alignment on a support bar 22. The support bar is preferably transparent, and formed from the same plastic as the trays 10. The trays are secured to the support bar by adhesively securing the lips 18 to the bar. Other means can be used for securing the lips to the support bar, such as heat welding or mechanical fasteners. A plurality of holes 24 are formed in support bar 22, for the purpose of securing the support bar to the wall of a display rack, as will be explained hereinafter. Bolts can be placed through the holes 24, and secured on the wall by associated nuts.

The trays 10 are adapted to support a plurality of non-prescription eyeglasses 26, in the same manner as the eyeglasses were supported on the prior art support structures shown in the patents identified above. The eyeglasses are folded, with the temples 28 folded against the rear of the lenses 30. The bridges 32 of the frames are positioned over the top of the bar 20.

The trays are used by placing a pair of glasses 26 on the base 12 with the bar 20 positioned between the lenses 30 and under the bridge 32. The base 12 projects at an angle to the lip 18, and thus the support bar 22, with the preferred angle being approximately 20 degrees. When the glasses are placed on the base, they will slide to the rear of the base until the temples rest against flange 16. When a pair of glasses is tried on to test, for comfort and the proper magnification, and then it is returned to the tray 10, it will automatically slide to the rear of the tray, under the force of gravity. No special care need be taken in replacing the glasses, since all that is necessary is to place them on the tray. The front lip 14 will prevent the glasses from being inadvertently knocked off the tray if they are pushed forward. The lenses 30 will prevent the glasses from sliding to either side of the tray, thereby obviating their being slid off to the side of the tray.

The base 12 can project at any acute angle relative to the support bar 22. All that is necessary is that the angle be sufficiently steep to permit the eyeglasses to slide to the rear of the tray. Although approximately a 20-degree angle is the preferred angle, any angle that accomplishes the purpose of causing the glasses to slide to the rear of the tray, under the force of gravity, can be used. Angles less than 20 degrees can also be used, even though the gravitational force will be reduced. Angles greater than 20 degrees can also be used, but the larger the angle, the sharper the incline, and the less aesthetically pleasing the display will be. The range of angles can be between approximately 5 degrees and 35 degrees, with the preferred angle being approximately 20 degrees.

Figure 2:
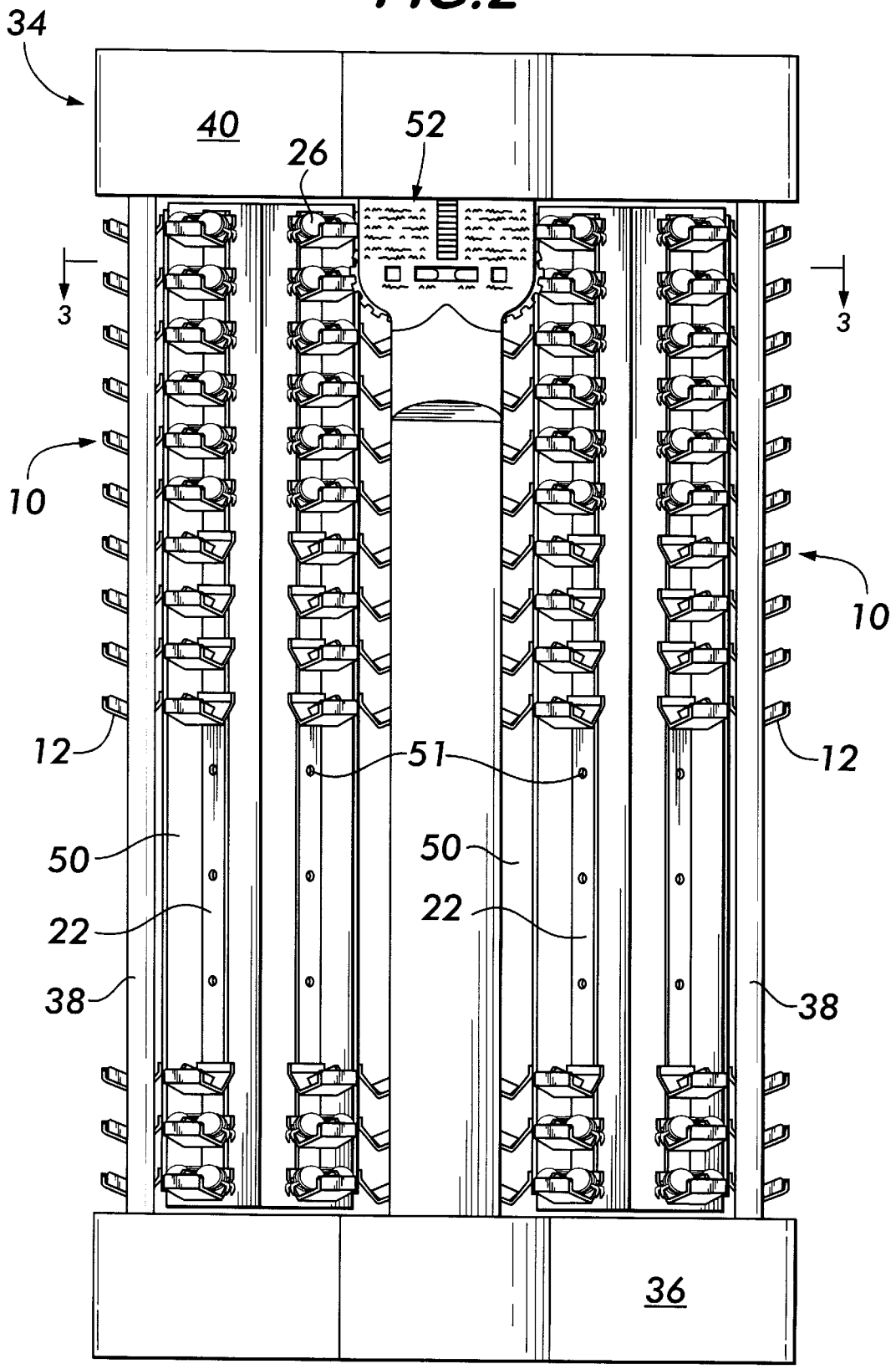
FIG. 2 is a front elevational view of an eyeglass display rack embodying this invention.
Figure 3:
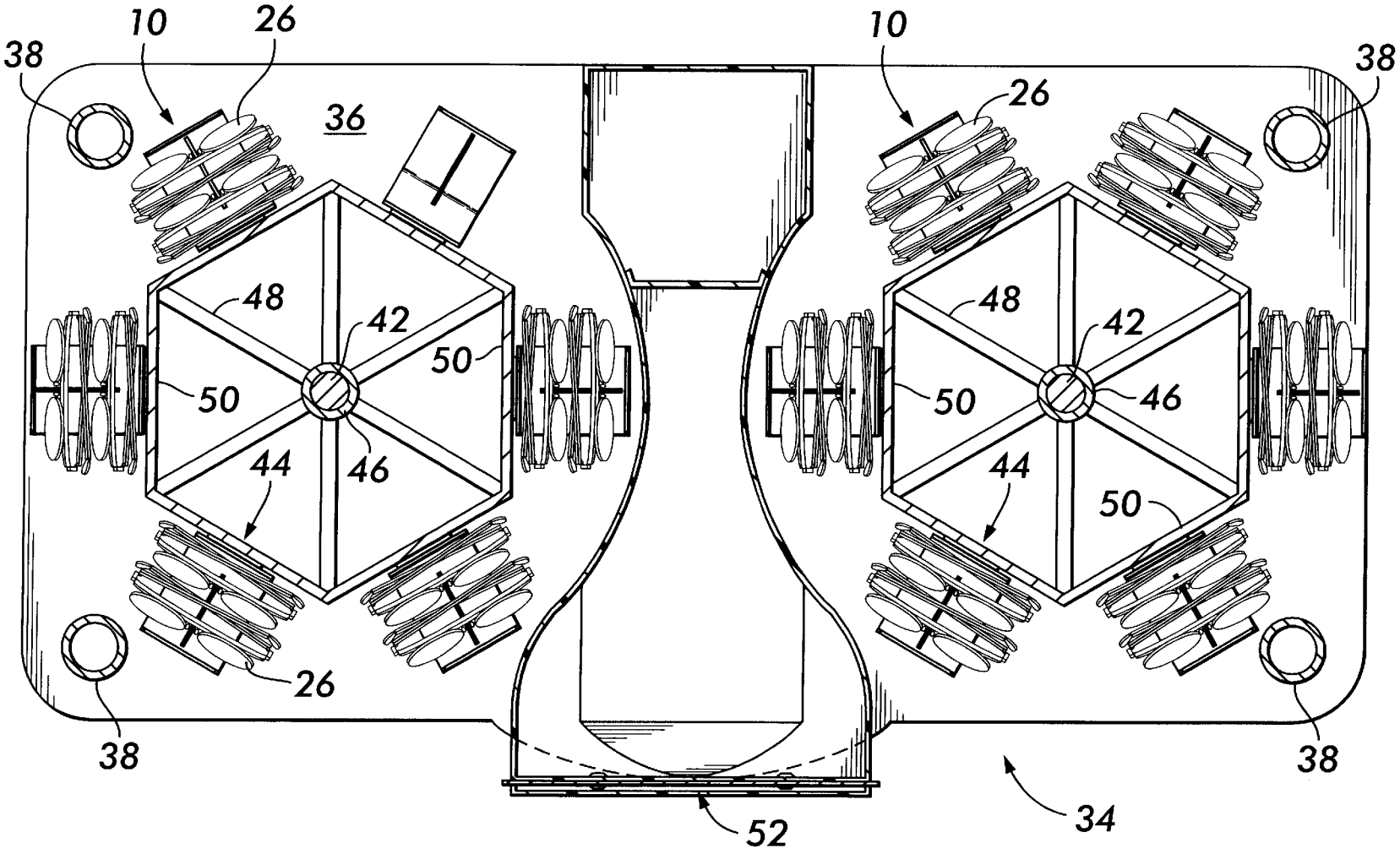
FIG. 3 is an enlarged sectional view taken along the line 3—3 of FIG. 2.

Referring now to FIGS. 2 and 3, an eyeglass display rack on which the trays 10 are supported is generally shown at 34. Display rack 34 includes a base 36 and four vertical support poles 38. A top 40 is supported by poles 38 (FIG. 2). A pair of rods 42 (FIG. 3) extend vertically upward from the base 36 to top 40, and are secured in the top and base.

An eyeglass display member 44 is rotatably mounted on each rod 42. Each eyeglass display member includes a center shaft 46, which is rotatably mounted on rod 42, and supports 48, which are secured to shaft 34 and extend radially therefrom. Walls 50 are secured to and supported by supports 48, and extend from the base 36 to the top 40.

Each wall 50 has mounted thereon a support bar 22 (FIG. 2). The support bar can be a unitary piece that extends for the entire height of walls 50 or can be two or more separate pieces which are secured to the wall in vertical alignment. The support bar or aligned bars 22 are secured on the walls by bolts 51 (FIG. 2) which pass through openings 24 (FIG. 1), and associated nuts (not shown) in the rear of the walls 50. The eyeglass trays 10 project, in cantilever, from the walls 50, through the use of the support bars 22. As is apparent in FIG. 2, the bases 12 project at an acute angle from the walls 50. Eyeglasses 26 are supported on the eyeglass trays 10. An enlarged view of the upper portion of the eyeglass display rack 34 is shown in FIG. 4.

Mounted in the center of rack 34 is a vision tester, generally shown at 52. The vision tester is described in detail in our prior U.S. Pat. No. 5,861,941, the disclosure of which is incorporated by reference herein. By way of summary, when a customer wishes to purchase non-prescription reading glasses, he will utilize the vision tester 52 to determine the proper degree of magnification needed for the reading glasses. The customer will then locate the glasses having this degree of magnification on the trays 10. The customer can then select the appropriate style of reading glasses from those having the proper degree of magnification.

The vision tester is shown on the display rack 34 as a preferred embodiment of this invention. It should be understood, however, that any rack structure can be used for carrying the trays 10, so long as the bases 12 of the trays project at an acute angle from the wall on which they are supported on the rack.

A modified embodiment of the tray 10 is shown at 54 in FIG. 5. Embodiment 54 is the same in structure as embodiment 10, in that it includes the base 12, the front lip 14, the rear flange 16 and the lip 18 on the flange. Embodiment 54 differs from embodiment 10 by the inclusion of a double-faced, pressure sensitive adhesive tape 56 on lip 18. Tape 56 has one surface adhesively secured to the lip 18. The outer surface also contains pressure sensitive adhesive, and it can be adhered to any vertical supporting surface, such as a wall 50 of a display rack or a support bar 22. The surface for attachment of the tray 54 can have a peel-off tape, in order to protect the pressure-sensitive adhesive until the tray 54 is to be used. The tray can be used on any display rack, or can be adhesively secured to any wall or display card within a store. The adhesive-mounted embodiment 54 is adapted for use for displaying a small number of glasses, such as at a cash register, in order to alert customers that a larger display rack with numerous eyeglasses to choose from is available within the store.

The display rack with the eyeglass trays of this invention presents an attractive display for vending non-prescription eyeglasses, while at the same time permitting a customer to easily remove a pair of eyeglasses for trying them on and thereafter replacing them on the rack. All that the customer need do is fold the temples and lay the eyeglasses on a tray to return them to the rack. There is no necessity of placing the temples in pre-selected notches or spaces on a support. Merely laying the eyeglasses in place permits gravity to neatly position the eyeglasses on a tray.

Although the eyeglass trays have been described as being heat welded to the support bars or adhesively secured to the walls of a display rack or the support bars, it should be understood that the trays can be supported in other ways known to the art. For instance, they can be supported by hooks placed in vertically aligned holes in the walls 50, as shown and described in U.S. Pat. Nos. Des. 374,786 and 5,861,941. They can also be supported by hook-and-loop fasteners, sold under the trademark Velcro.

Although the invention has been described with respect to the vending of nonprescription eyeglasses, it can also be used with displaying and vending eyeglass frames which can then be fitted with prescription lenses. It can also be used with displaying and vending non-prescription sunglasses.

Without further elaboration, the foregoing will so fully illustrate this invention that others may, by applying current or future knowledge, readily adapt the same for use under various conditions of service.

We claim:

1. A tray adapted to support thereon at least two eyeglasses each having a pair of temples and a bridge, said tray comprising a base, a lip projecting upwardly at the front of the base and a flange projecting upwardly at the rear of the base, said flange having a lip projecting therefrom, and a vertically extending bar secured to and positioned in the middle of the base and extending from the front lip to the rear flange, with said base projecting at an acute angle relative to said lip projecting from said flange for automatically creating a return space for any one of the at least two eyeglasses that are removed from said tray when said lip projecting from said flange is coupled to a vertical support, each of the eyeglasses being supported on said tray whereby the temples of said eyeglasses are adapted to extend downwardly with the bridges of said eyeglasses adapted to be positioned on each side of said vertically extending bar.

2. The tray of claim 1, wherein said base, front lip, flange and lip projecting from said flange are unitary.

3. The tray of claim 1, wherein said base, front lip, flange and lip projecting from said flange are transparent.

4. The tray of claim 3, wherein said vertically extending bar is transparent.

5. The tray of claim 1, wherein said lip projecting from said flange contains means for securing the tray to a support for the tray.

6. The tray of claim 5, wherein said securing means comprises a pressure sensitive adhesive strip secured to said lip projecting from said flange.

7. The tray of claim 1, wherein said acute angle is between approximately 5 degrees and 35 degrees.

8. The tray of claim 1, wherein said acute angle is approximately 20 degrees.

9. An eyeglass display rack comprising a wall and a plurality of trays secured to said wall and projecting in cantilever therefrom, each of said trays having a base and a vertically extending bar secured to and projecting from the middle of said base, each of said trays adapted for supporting thereon at least two eyeglasses, each having a pair of temples and a bridge, said base projecting at an acute angle relative to said wall for automatically creating a return space for any one of said at least two eyeglasses that are removed from any one of said trays, each of the eyeglasses being supported on said trays whereby the temples of said eyeglasses are adapted to extend downwardly with the bridges of said eyeglasses adapted to be positioned on each side of said vertically extending bar.

10. The display rack of claim 9, wherein said trays are vertically spaced and aligned on said wall.

11. The display rack of claim 10, wherein said trays are secured to a support bar, and said support bar is secured to said wall.

12. The display rack of claim 9, wherein said tray further includes a flange projecting upwardly at the rear of said base, said flange having a lip projecting therefrom, with said lip being secured to said wall.

13. The display rack of claim 12, wherein said lip is secured to said wall by a support bar mounted on said wall, with the lips of all of said trays being secured to said support bar.

14. The display rack of claim 9, wherein said acute angle is between approximately 5 degrees and 35 degrees.

15. The display rack of claim 9, wherein said acute angle is approximately 20 degrees.

16. The display rack of claim 9, wherein a plurality of walls are provided, said walls being contiguous with adjacent walls, whereby said walls form, in cross-section, a geometric shape, with said trays projecting in cantilever from all of said walls.

17. The display rack of claim 16, wherein said walls are secured to a central shaft, said shaft being rotatable on a vertically-extending pole.

18. The display rack of claim 9, wherein said base is transparent.

19. The display rack of claim 18, wherein said vertically-extending bar is transparent.

20. Support member for holding and displaying eyeglasses, each having a pair of temples and a bridge, said support member comprising a support bar and a plurality of trays secured to said support bar in spaced alignment, said trays projecting in cantilever from said support bar, each of said trays having a base and a vertically-extending bar projecting from, and secured to, the middle of said base, each of said trays adapted for supporting at least two eyeglasses, said base projecting at an acute angle relative to said support bar for automatically creating a return space for any one of said at least two eyeglasses that are removed from any one of said trays, each of the eyeglasses being supported on said trays whereby the temples of said eyeglasses are adapted to extend downwardly with the bridges of said eyeglasses adapted to be positioned on each side of said vertically extending bar.

21. The support member of claim 20, wherein said acute angle is approximately 20 degrees.

* * * * *